US008005377B2

(12) United States Patent
Yamazaki

(10) Patent No.: US 8,005,377 B2
(45) Date of Patent: Aug. 23, 2011

(54) IMAGE FORMING DEVICE

(75) Inventor: Kohichi Yamazaki, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 386 days.

(21) Appl. No.: 12/320,038

(22) Filed: Jan. 15, 2009

(65) Prior Publication Data

US 2009/0185815 A1 Jul. 23, 2009

(30) Foreign Application Priority Data

Jan. 17, 2008 (JP) ..... 2008-008148
Mar. 6, 2008 (JP) ..... 2008-057059
Dec. 16, 2008 (JP) ..... 2008-319367

(51) Int. Cl.
*G03G 15/00* (2006.01)

(52) U.S. Cl. ..... 399/44; 399/49

(58) Field of Classification Search ..... 399/44, 399/49, 55, 58, 60
See application file for complete search history.

(56) References Cited

U.S. PATENT DOCUMENTS 6,442,364 B2 8/2002 Kai et al.
2006/0078341 A1* 4/2006 Koga et al. ..... 399/44

FOREIGN PATENT DOCUMENTS

JP 11272070 A * 10/1999
JP 2001-242712 9/2001
JP 2001-312126 11/2001
JP 2002-278183 9/2002
JP 2002-278275 9/2002
JP 2008-209588 9/2008

* cited by examiner

*Primary Examiner* — David P Porta
*Assistant Examiner* — Frederick Wenderoth
(74) *Attorney, Agent, or Firm* — Harness, Dickey & Pierce, P.L.C.

(57) ABSTRACT

An image forming device includes an image carrier having a surface onto which an electrostatic latent image is formed, a development station including a case made of a conductive body and one or more developer rollers, which supply toner housed in the case to the surface of the image carrier, and develop the electrostatic latent image formed on the surface of the image carrier as a toner image, a unit, which forms a standard concentration toner image of on the surface of the image carrier, a detector, which detects a toner adhesion amount of the standard concentration toner image formed on the surface of the image carrier by the standard concentration toner image-forming unit, and a voltage controller, which controls a bias voltage to be applied to the case according to a detected result of the toner adhesion amount of the standard concentration toner image by the detector.

12 Claims, 8 Drawing Sheets

RELATIONSHIP BETWEEN DETECTED VALUE OF STANDARD CONCENTRATION TONER IMAGE ON END PORTION OF IMAGE CARRIER AND BIAS VOLTAGE OF CASE

RELATIONSHIP BETWEEN DIFFERENCE BETWEEN DETECTED VALUES OF STANDARD CONCENTRATION TONER IMAGES ON CENTRAL PORTION AND END PORTION OF IMAGE CARRIER AND BIAS VOLTAGE OF CASE

RELATIONSHIP BETWEEN THE NUMBER OF PRINTED SHEETS AND INCREASED AMOUNT OF EFFECTIVE DEVELOPMENT BIAS VOLTAGE

RELATIONSHIP BETWEEN THE NUMBER OF PRINTED SHEETS AND TONER ADHESION/FIXATION RANK TO CASE NO BIAS VOLTAGE CONTROL OF CASE

IMAGE FORMING DEVICE

PRIORITY CLAIM

The present application is based on and claims priorities from Japanese Patent Applications No. 2008-008148, filed on Jan. 17, 2008, No. 2008-057059, filed on Mar. 6, 2008, and No. 2008-319367, filed on Dec. 16, 2008, the disclosures of which are hereby incorporated by reference in their entirety.

BACKGROUND OF THE INVENTION

1. Field of the Invention

The present invention relates to a device which forms an image by means of an electrostatic copying process such as a copier, a facsimile, or a printer.

2. Description of the Related Art

In recent years, with the need for an increase in speed and the energy saving of a copier, a low-melting point toner has been developed. However, if the melting point of the toner is lowered above a certain level, various problems occur such as the development of errors and the fixation of toner onto a developer roller by the aggregation of toner. In particular, when outputting an electronic document, in most cases, a non-image part tends to continue in the same portion (especially, a blank space), and the toner is likely to be fixed onto the developer roller facing the non-image part of the electric document. Such fixation of toner onto the developer roller is likely to develop an undesirable image such as a stained surface.

Because the rotation speed of the developer roller is especially high in a high-speed copier, the temperature of the developer roller is prone to increase, and the low-melting point toner is likely to be fixed onto the developer roller. Moreover, in the non-image part, because an electrostatic force acts such that the toner is pressed onto the developer roller, the fixation of toner tends to occur in the developer roller.

In a negative/positive process (hereinafter referred to as a N/P process) which transfers toners onto an exposed portion of an image carrier, since the toner is charged to a polarity which is the same as a polarity of development bias potential, in an area where the toner is fixed, effective development potential onto an image carrier increases. Therefore, when ensuring a sufficient development performance in an area to which the toner does not adhere, the development performance becomes too great in an area where the toner is fixed, causing an abnormal image such as a stained surface.

In this case, a cooling effect is improved by applying a conductor in a case of a development station. In a technique which applies the conductor in the case, in order to prevent the leakage of a development bias voltage, it is arranged to provide continuity across the case and the surface of the developer roller, and to maintain the electric potential of the case and the development bias potential at the same electric potential. With this structure, in the area of the developer roller to which the toner is fixed, an electric potential difference locally occurs relative to the case; thus, the toner is developed on the case from the surface of the developer roller, and then the adhesion/fixation of toner is developed on a part of the case facing the developer roller. In this case, when the toner fixed onto the developer roller is eliminated by maintenance or the like, the toner is attracted to the developer roller from the case because effective electric potential of the part of the case to which the toner adheres/is fixed is higher than the electric potential of the surface of the developer roller. As a result, the toner is even fixed on the surface of the developer roller corresponding to the non-image part which originally does not cause the fixation of toner.

In order to prevent the fixation of toner onto the developer roller, various techniques are proposed. JP2001-312126A proposes a method of preventing the fixation of toner onto a developer roller, which sets a background potential (difference between charged electric potential of image carrier and development bias potential) to be 400V or more at an absolute value, and develops a solid image on the image carrier in the end portion of the developer roller in the axial direction thereof, in an image forming device with a two-component developer using low-melting point toner. However, in this method, the solid image developed on the image carrier is input to a cleaning station of the image carrier or a cleaning station of a downstream transfer station, so that the load on the cleaning station is increased.

In addition, JP2002-278275A proposes a method of electrostatically removing toner on a developer roller by applying a bias voltage to a collection member facing the developer roller. However, in this method, the mechanism becomes complex by the increase in the number of parts, and the costs of the development station are increased.

Moreover, JP2001-242712A proposes, in order to prevent the fixation of toner onto a developer roller resulting from the stress of developer between the developer roller and an image carrier, a developer roller which prevents the fixation of toner without losing development performance by minimizing a half-value width of a development magnetic pole.

Furthermore, JP2002-278183A proposes an image forming device, which controls a defect of toner concentration control resulting from the fixation of toner onto a developer roller. Because the fixed toner is charged in the toner fixation area of the developer roller, effective development potential is increased. Accordingly, when performing normal control, in the toner fixation area, the toner adhesion amount of a patch for measuring the toner adhesion amount on the image carrier is increased, compared to an area where the toner is not fixed. Consequently, if the concentration of toner is controlled according to the toner adhesion amount of the patch for measuring the toner adhesion amount, a low concentration of toner is set in an area where the toner is not fixed, resulting in the decrease in the concentration of an image. In this image forming device, the development bias potential and the electrostatic latent image potential are controlled to be the same, and the toner adhesion amount of the patch for measuring the toner adhesion amount is measured in this state, so that the increase in the effective development bias potential by the fixation of toner is detected and is used for controlling the concentration of toner.

SUMMARY OF THE INVENTION

It is, therefore, an object of the present invention to provide an image forming device, which controls fixation of toner onto a case, prevents generation of a defect associated with the fixation of toner onto the case, and also extends a replacement cycle of a development station.

In order to achieve the above-described object, the present invention relates to an image forming device including an image carrier having a surface onto which an electrostatic latent image is formed, a development station including a case made of a conductive body and one or more developer rollers, which supply toner housed in the case to the surface of the image carrier, and develop the electrostatic latent image formed on the surface of the image carrier as a toner image, a unit, which forms a standard concentration toner image of on the surface of the image carrier, a detector, which detects a toner adhesion amount of the standard concentration toner image formed on the surface of the image carrier by the standard concentration toner image-forming unit, and a voltage controller, which controls a bias voltage to be applied to the case according to a detected result of the toner adhesion amount of the standard concentration toner image by the detector.

Preferably, the standard concentration toner image-forming unit forms the standard concentration toner image on a surface of a central portion and a surface of an end portion of the image carrier in a longitudinal direction thereof, the detector detects the toner adhesion amount of the standard concentration toner image formed on the surface of the central portion and the surface of the end portion of the image carrier in the longitudinal direction thereof, and the voltage controller controls the bias voltage to be applied to the case according to a difference between the toner adhesion amount of the standard concentration toner image formed on the surface of the central portion of the image carrier in the longitudinal direction thereof detected by the detector and the toner adhesion amount of the standard concentration toner image formed on the surface of the end portion of the image carrier in the longitudinal direction thereof detected by the detector.

Preferably, the standard concentration toner image-forming unit forms the standard concentration toner image on the surface of the central portion and the surface of the end portion of the image carrier in the longitudinal direction thereof at a different latent image electric potential to each other.

Preferably, the image forming device further includes a doctor blade, which is disposed to face to the developer roller, and controls the amount of toner to be supplied to the surface of the image carrier by the developer roller, and a distance of a space formed between the developer roller and the doctor blade is different at the central portion and the end portion of the developer roller in the longitudinal direction thereof.

Preferably, a surface roughness of the developer roller is different on the central portion and the end portion of the developer roller in the longitudinal direction thereof.

Preferably, the image forming further includes a humidity detector, which detects humidity of a circumference of the image forming device, and the voltage controller controls the bias voltage to be applied to the case according to the humidity detected by the humidity detector.

Preferably, the toner includes toner particles having a range of 4-10 μm in terms of a weight average particle diameter and 60-80% of the toner particles have a weight average particle diameter of 4 μm or below.

Preferably, the image forming device further includes a voltage application unit, which applies a bias voltage to the development rollers, and the bias voltage to be applied by the voltage application unit to the developer roller disposed in a most downstream rotation direction of the image carrier is different from the bias voltage to be applied by the voltage application unit to another developer roller.

Preferably, the standard concentration toner image-forming unit forms the standard concentration toner image on a central portion and an end portion of the image carrier in the longitudinal direction thereof, the detector detects the toner adhesion amount of the standard concentration toner image formed on the central portion and the end portion of the image carrier in the longitudinal direction thereof, and the voltage controller controls the bias voltage to be applied to the case according to a difference between the toner adhesion amount of the standard concentration toner image formed on the central portion of the image carrier in the longitudinal direction thereof detected by the detector and the toner adhesion amount of the standard concentration toner image formed on the end portion of the image carrier in the longitudinal direction thereof detected by the detector.

Preferably, the image forming device further includes a counter, which counts the number of printed sheets of the toner image formed on the image carrier, and the voltage controller controls the bias voltage to be applied to the case according to a result of the counter.

Preferably, the image forming device further includes a humidity detector, which detects humidity of a circumference of the image forming device, and the voltage controller controls the bias voltage to be applied to the case according to the humidity detected by the humidity detector.

Preferably, the toner includes toner particles having a range of 5-10 μm in terms of a weight average particle diameter and 60-80% of the toner particles have a weight average particle diameter of 5 μm or below.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

DETAILED DESCRIPTION OF THE PREFERRED EMBODIMENTS

Figure 1:
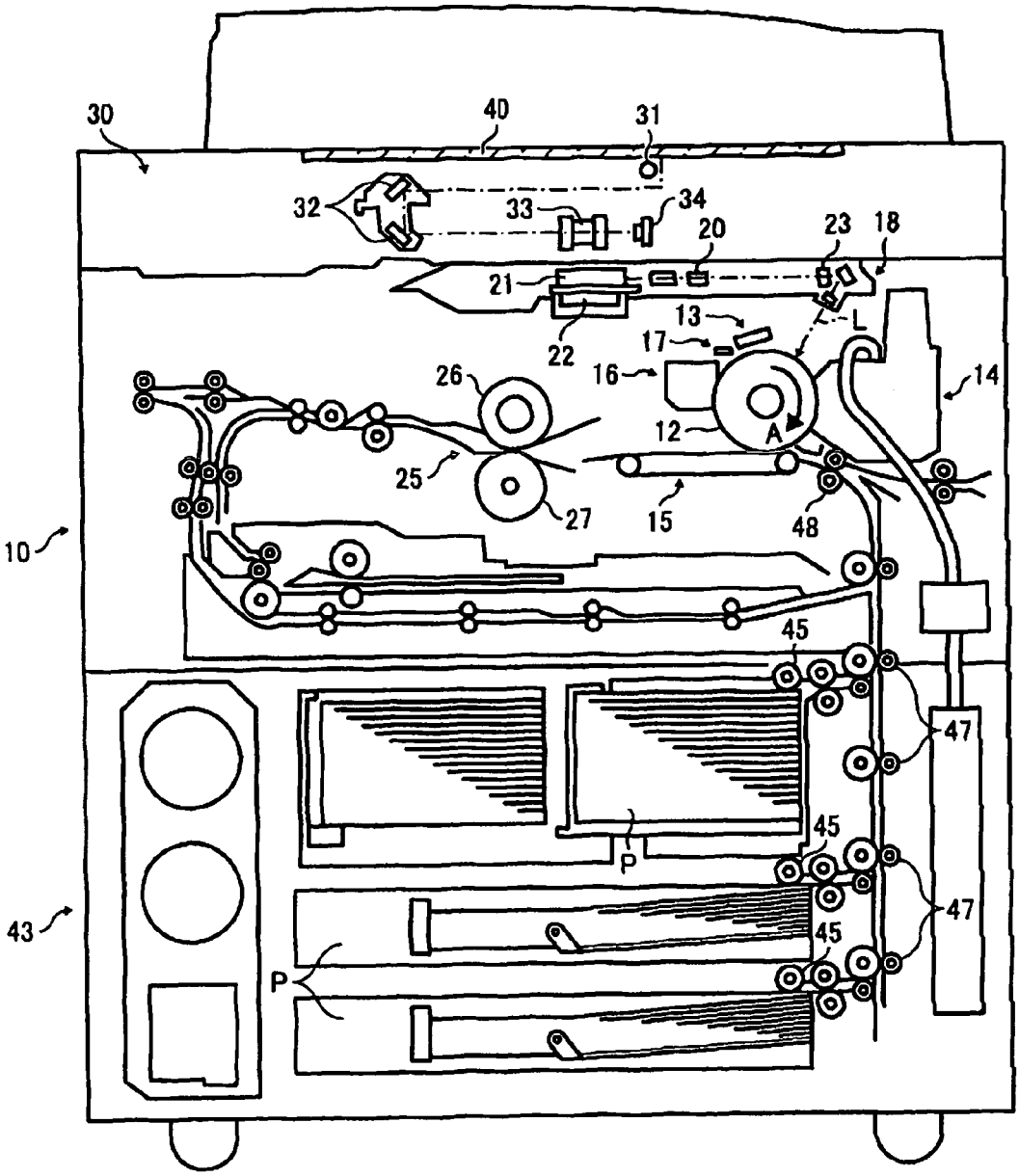
FIG. 1 is a sectional view illustrating a schematic structure of an image forming device according to one embodiment of the present invention.
Figure 2:
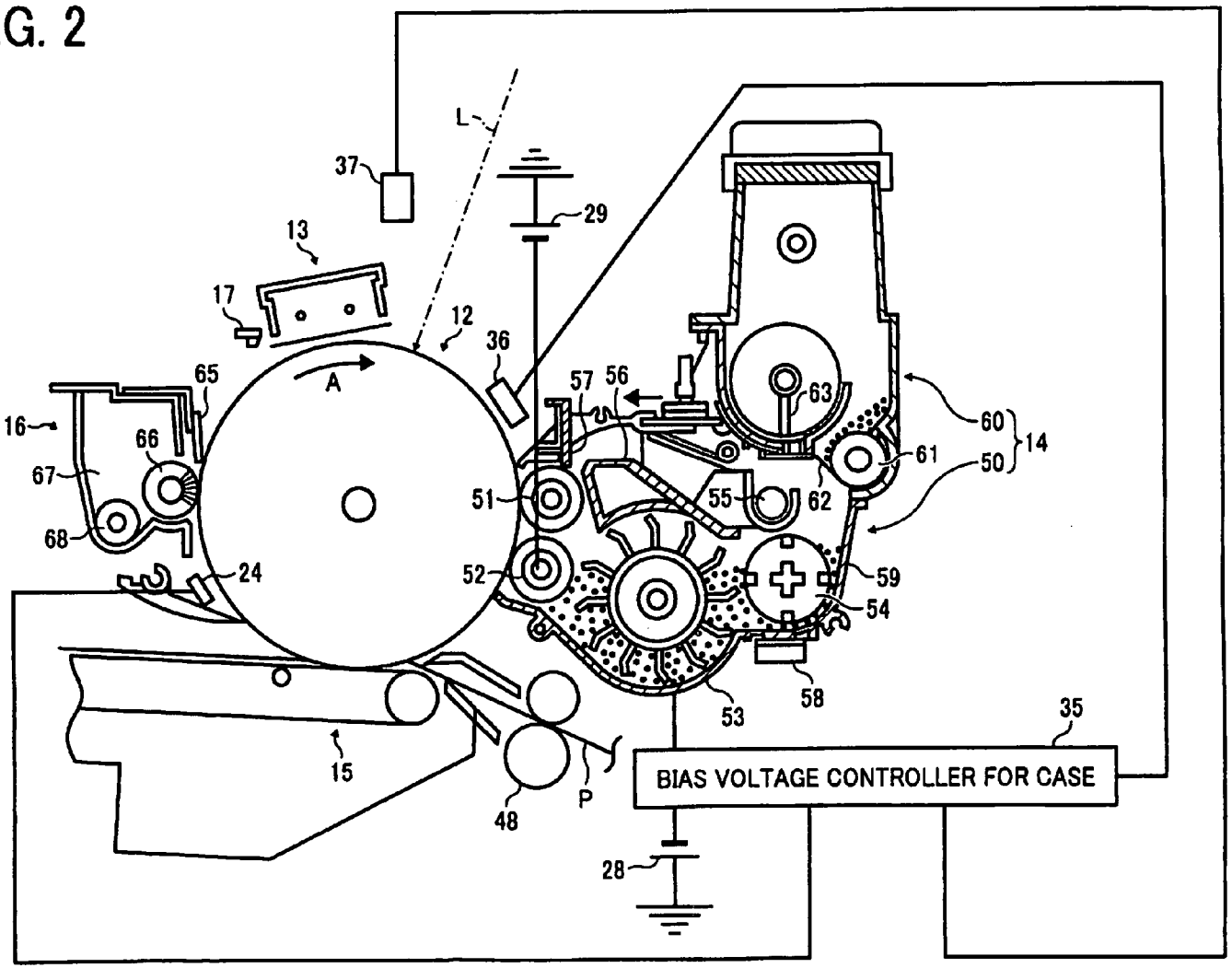
FIG. 2 is a sectional view illustrating an image forming section of the image forming device according to one embodiment of the present invention.

Hereinafter, an embodiment of the present invention will be described with reference to the drawings. Referring to FIGS. 1, 2, a laser copier 10 includes a drum-shaped photoconductor 12, which is a type of image carrier. The photoconductor 12 includes therearound a charging station 13, a development station 14, a transfer and feeding station 15, a cleaning station 16 and an electrostatic eliminator 17. A laser writing station 18 is provided above those. The laser writing station 18 includes a light source 20 such as a laser diode, a polygon mirror 21 for laser-scanning, a motor 22, and a scanning optical system 23 such as an fθ lens. The left side of the cleaning station 16 is provided with a fuser station 25 including a fuser roller 26 having a heater inside thereof and a pressure roller 27 which presses the fuser roller 26 from the lower side thereof. The copier 10 includes an upper portion provided with an original reading station 30. The original reading station 30 includes a light source 31, a plurality of mirrors 32, a focusing lens 33, and an image sensor 34 such as a CCD.

In the laser copier of the present embodiment, image information of an original read by the original reading station 30 is converted into electric signals, and the signals are sent to the laser writing station 18. In the laser witting station 18, laser light is modulated according to the image information converted into the electric signals, and the modulated laser light is irradiated onto the surface of the photoconductor 12 by the polygon mirror 21. The surface of the photoconductor 12 is uniformly charged by the charging station while rotating in the direction of the arrow A by a driving motor (not shown). An electrostatic latent image corresponding to the image information is formed on the uniformly charged surface of the photoconductor 12 by laser light L which scans the photoconductor 12 in the axial direction thereof by the laser writing station 18. The electrostatic latent image formed on the surface of the photoconductor 12 is developed as a toner image by the toner supplied from the development station 14. The toner image formed on the surface of the photoconductor 12 is transferred by the transfer and feeding station 15 onto a transfer member P such as transfer paper fed by a resist roller 48 at an adjusted time. The transfer member P onto which the toner image is transferred is fed to the fuser station 25 by the transfer and feeding station 15, and is heated and pressed by the fuser roller 26 and the pressure roller 27 of the fuser station 25, so as to be fused onto the transfer member P. After that, the transfer member P having the fused toner image is discharged by a paper-discharge roller 19.

On the other hand, as illustrated in FIG. 2, the toner remaining on the surface of the photoconductor 12 onto which the toner image is transferred is eliminated by a cleaning brush roller 66 and a cleaning blade 65 of the cleaning station 16, and the electric charge remaining on the surface of the photoconductor 12 is eliminated by the electrostatic eliminator 17. Accordingly, the toner image is formed on the surface of the photoconductor 12, and this toner image is transferred onto the transfer member P, so that an image is formed on the transfer member P. The transfer member P is fed by a paper-feeding roller 45 one by one, and is fed to a resist roller 48 by a transfer roller 47.

Next, the formation of the toner image on the photoconductor 12 by the development station 14 will be described with reference to FIG. 2. The development station 14 includes a development tank 50 and a development hopper 60 as illustrated in FIG. 2. The development tank 50 includes a case 59 having inside thereof a first developer roller 51, a second developer roller 52, a paddle wheel 53, an agitation roller 54, a transfer screw 55, a separator 56, a doctor blade 57, and a toner concentration sensor 58. The case 59 houses a two-component developer (toner) made of nonmagnetic toner particles and magnetic carrier particles. The development hopper 60 includes inside thereof a gear-shaped toner supplying member 61, a supply control plate 62, and an agitator 63. The development hopper 60 houses toner.

In this development station 14, the two-component developer made of nonmagnetic toner particles and magnetic carrier particles is housed in the case 59. The two-component developer is agitated by the rotation of the agitation roller 54, so that the developer abrades away and is charged. Then, the developer is splashed by the rotation of the paddle wheel 53, and is supplied to the first developer roller 51. The two-component developer is absorbed to the surfaces of the first and second developer rollers 51, 52 by the magnets provided in the central portions of the first and second developer rollers 51, 52, respectively.

The two-component developer absorbed to the first developer roller 51 passes through the gap between the surface of the developer roller 51 and the leading end of the doctor blade 57 by the rotation of the developer roller 51. In this case, surplus two-component developer which can not pass through the gap is removed, and the defined amount of developer which is defined by the gap is fed. After that, the two-component developer is fed to the second developer roller 52 from the first developer roller 51 by the rotation of the rollers, and goes back to the case 59. In this case, if the developer on the first and second developer rollers 51, 52 has contact with the photoconductor 12, the toner is developed on the photoconductor 12 according to the bias voltage applied to the first and second developer rollers 51, 52 by a power source 29, and the electrostatic latent image formed on the surface of the photoconductor 12 becomes the toner image.

In this embodiment, the bias voltage is applied to the developer rollers 51, 52 and the case 59 (made of aluminum) from the power sources 29, 28, respectively. The bias voltage of −650V is applied to the developer rollers 51, 52, and the bias voltage controlled by a bias voltage controller 35 of the case (hereinafter, referred to as the bias voltage of the case) as described below is applied to the case 59. The linear velocity of the developer roller 51 in this embodiment is 700 mm/sec.

In the development station 14, if the toner adheres to the photoconductor 12, the toner concentration in the developer (toner ratio) is lowered. If the toner concentration in the developer is lowered at a predetermined value relative to a target value, the toner is fed to the toner supply member 61 while being agitated by the rotation of the agitator 63. Then, the supply control plate 62 moves by the rotation of the toner supply member 61. Thereby, the toner is supplied to the development tank 50 from the development hopper 60.

Accordingly, the toner concentration in the developer is maintained. The toner concentration in the developer is measured by the toner concentration sensor 58 attached to the case 59.

In the image forming device of the present embodiment, a latent image for a patch showing standard concentration (hereinafter referred to as a standard concentration patch latent image) is written on the surface of the photoconductor 12 at the predetermined number of sheets. This standard concentration patch latent image is developed as a patch showing standard concentration (hereinafter referred to as standard concentration patch) at a predetermined development potential (an electric potential difference between the patch latent image and the development roller, 280V in this embodiment) by applying a bias voltage. The reflection concentration of the standard concentration patch is detected by a reflection concentration sensor 24, and the toner in the development hopper 60 is supplied to the development tank 50 such that the reflection concentration is maintained within a predetermined range. The background concentration (Vsg0) is detected in a state in which the surface of the photoconductor 12 has no adhesion of toner at all when starting (before developing) the photoconductor 12 in a single operation for forming an image. By detecting the background concentration (Vsg0), the change in the output of the reflection concentration sensor 24 by a factor in addition to the adhesion amount of toner can be detected, so that the decrease in the output by the stain of the sensor can be corrected.

In the following embodiments, the development station 14 uses a two-component developer containing toner made of toner particles and carriers having a weight average particle diameter of 65 μm or below. The toner particles include a range of 5-10 μm in terms of a weight average particle diameter, and 60-80% of the toner particles have a particle diameter of 5 μm or below. The toner may contain a resin component or a coloring agent, and also may contain a wax component or an inorganic particulate. A method of manufacturing the developer is not especially limited. A grinding method or a polymerization method can be used. In addition, as a device for measuring an average particle diameter, Coulter Counter TA-II and Coulter Multisizer II (made by Coulter, Inc.) are used.

All conventionally known all resins can be used as the resin component of the toner. For example, the following resins can be used.

The resin component of the toner includes styrene resin (a polymer or a copolymer containing a styrene or a styrene substitution) such as a styrene, a poly-α-stillstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylic acid ester copolymer, a styrene-methacrylic acid ester copolymer, a styrene-α-chloracrylic acid methyl copolymer, or a styrene-acrylonitrile-acrylic acid ester copolymer, a polyester resin, an epoxy resin, a vinyl chloride resin, a rosin-modified maleic acid resin, a phenol resin, a polyethylene resin, a polyester resin, a polypropylene resin, a petroleum resin, a polyurethane resin, a ketone resin, an ethylene-ethyl acrylate copolymer, a xylene resin, and a polyvinylbutyrate resin. Each of these resins can be used by itself, but two types of resins can be combined.

The coloring agent is not especially limited. As the coloring agent, a known coloring agent such as a carbon black, a lampblack, an iron black, an ultramarine blue, a nigrosine dye, an aniline blue, a chalcooil blue, an oil black, or an azo oil black is used. The wax component is also not especially limited. As the wax component, a known wax component such as a carnauba wax, a rice wax, or a synthetic ester wax is used. The inorganic particulate is also not especially limited. As the inorganic particulate, a known inorganic particulate such as a silica or an oxidized titanium fine powder can be used.

As described above, the toner transferred onto the photoconductor 12 is electrostatically transferred to the transfer member P by the transfer and feeding station 15. However, about 10% of the toner remains on the photoconductor 12 without being transferred onto the transfer member. The toner remaining on the photoconductor 12 (residual toner) is removed from the photoconductor 12 by the cleaning blade 65 or the brush roller 66 provided in the cleaning station 16. The toner removed from the photoconductor 12 by the cleaning station 16 is accumulated in the collection tank 67 in the cleaning station 16. The toner accumulated in the collection tank 67 is fed outside the cleaning station 16 by the collection screw 68, and discharged from a discharging exit (not shown) so as to be guided to a toner recycling station (not shown).

Next, an embodiment of the bias voltage to be applied to the developer roller and the case will be described.

Embodiment 1

In this embodiment, in order to detect the increase in an effective development bias voltage resulting from the fixation of toner onto the surfaces of the developer rollers 51, 52, a toner image showing a standard concentration (hereinafter referred to as a standard concentration toner image) is formed at a predetermined timing (for example, every 5000 sheets) on the end portion of the photoconductor 12 in the longitudinal direction thereof (the scanning direction of the laser light), and this standard concentration toner image is detected by the reflection concentration sensor 24. Similar to the above-described standard concentration patch, the charging station or the like, which is disposed around the photoconductor 12, is used for forming the standard concentration toner image. However, the timing and the writing light volume of the laser light for forming the standard concentration toner image are different from those for forming the standard concentration patch. Therefore, a unit for forming a standard concentration toner image includes all stations for forming an image and a controller which controls these stations. The reason for forming the standard concentration toner image on the end portion of the photoconductor 12 in the longitudinal direction thereof is that since the end portion of each developer roller 51, 52 in the longitudinal direction thereof tends to correspond to an area outside an image or a blank space, the toner is likely to be fixed onto the surface of each developer roller 51, 52, so that the increase in the development performance by the fixation of toner can be easily detected. In this embodiment, the reflection concentration sensor 24 is disposed in a position corresponding to the end portion of the maximum width of the transfer member P. When forming the standard concentration toner image, the bias voltage to be applied to the developer roller (in this embodiment, the developer roller 52) disposed most downstream in the rotation direction of the photoconductor (image carrier) is set larger than the bias voltage to be applied to the developer rollers (in this embodiment, the developer roller 51), except for the developer roller disposed most downstream. Thereby, the development potential (difference between the electric potential of the latent image on the photoconductor and the bias voltage) of the developer roller disposed most downstream becomes larger than the development potential of other developer rollers. The developer roller (developer roller 52) disposed most downstream in the rotation direction of the photoconductor is generally the most sensitive roller relative to a quality of an image to be formed. For this reason, if the fixation of toner onto the developer roller (developer roller 52) disposed most downstream in the rotation direction of the photoconductor is detected before the fixation of toner onto other developer rollers (developer roller 51) is detected, the deterioration in an image quality can be effectively controlled. Therefore, in this embodiment, by setting the bias voltage to be applied to the developer roller (developer roller 52) disposed most downstream in the rotation direction of the photoconductor larger than the bias voltage to be applied to other developer rollers (developer roller 51), the detection sensitivity of the increase in the effective development bias voltage of the developer roller (developer roller 52) facing the case 59, which means the generation of the adhesion/fixation of toner to the case 59 causing the fixation of toner onto the developer roller (developer roller 52), can be improved.

Figure 3:
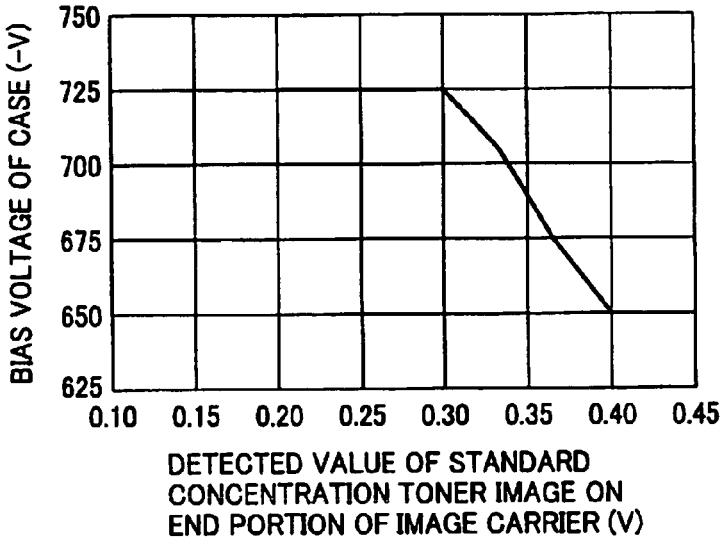
FIG. 3 is a graph illustrating the relationship between the detected values of a standard concentration toner image on an end portion of an image carrier and the bias voltage of a case in embodiment 1.

In this embodiment, when forming the standard concentration toner image for use in the detection of the increase in the effective development bias voltage, the bias voltage to be applied to the developer rollers 51, 52 is set such that the developer roller (in this embodiment, the developer roller 52) disposed most downstream in the rotation direction of the photoconductor (image carrier) becomes −650V and other developer rollers (in this embodiment, the developer roller 51) become −450V. The bias voltage of the case 59 as illustrated in FIG. 3 is set according to the detection results of the standard concentration toner image formed on the end portion of the photoconductor in the longitudinal direction thereof. The bias voltage of the case 59 can be obtained by an experiment. The data in FIG. 3 is obtained by forming a plurality of developer rollers each having a different fixation amount of toner, and obtaining the output of the sensor of the standard concentration toner image when using each roller and the bias voltage which controls the fixation of toner onto the case. As illustrated in FIG. 3, as the detected value of the standard concentration toner image is decreased, a thicker standard concentration toner image is formed. More particularly, if the detected value of the standard concentration toner image is decreased, the effective development bias voltage is increased by the fixation of toner. In this case, the bias voltage to be applied to the case 59 is increased. Thereby, the potential difference between the developer rollers 51, 52 and the case 59 can be decreased even if the effective development bias voltage is increased, so that the adhesion/fixation of toner onto the case 59 can be controlled. The results of the printing experiment of 500000 sheets (corresponding to a maintenance interval) according to this embodiment are illustrated in the following Table 1.

TABLE 1

| Setting method of bias voltage of case | Setting method of development bias voltage when forming standard concentration toner image | Adhesion/ fixation of toner to case (printing of 500000 sheets) | Determination |
|---|---|---|---|
| Set fixed value | | Toner fixation at printing of 200000 sheets | x |
| Set value according to detected value of standard concentration toner image on end portion | Set same value for first and second developer rollers | Toner fixation at printing of 400000 sheets | x |
| Set value according to detected value of standard concentration toner image on central portion and end portion of image carrier | Set different value for first and second developer roller | Toner fixation at printing of 500000 sheets | Δ |
| Set value according to difference of detected values of standard concentration toner image on central portion and end portion of image carrier | ↑ | No adhesion/ fixation of toner | ○ |

When the bias voltage of the case was not controlled (the bias voltage of the case was set to a fixed value), the toner was fixed onto the case at the printing of 200000 sheets. On the other hand, when the bias voltage of the case was controlled according to the detected value of the standard concentration toner image on the end portion, the toner was fixed onto the case at the printing of 400000 sheets, provided that the bias voltage of the developer rollers 51, 52 when forming an image was the same. Moreover, when a different bias voltage was applied to the developer rollers 51, 52, the toner was not fixed onto the case although the toner adhered to the case 59, which is an acceptable level, at the printing of 500000 sheets. This is because the increase in the effective development bias voltage of the developer roller 52 facing the case 59 was more accurately detected, and the fixation of toner onto the case 59 was controlled. In a stage before the fixation of toner occurs, the toner which adheres to the case 59 can be removed by simply shaking the development station, and the adhesion/fixation of toner onto the case 59 can be controlled if the maintenance interval is appropriately maintained. In addition, the number of printed sheet is counted by a counter provided in the bias voltage controller 35.

Embodiment 2

When detecting the standard concentration toner image only on the end portion of the photoconductor in the longitudinal direction thereof, if the development performance is changed according to the change in the toner concentration and the change in the environment, the toner image showing high standard concentration may be detected even if the effective development bias voltage is not increased by the fixation of toner. In this case, if the bias voltage of the case is controlled, an electric field causing the movement of toner from the case to the developer roller is generated between the developer roller and the case, so that the toner excessively adheres to the developer roller.

In this embodiment, the standard concentration toner images are formed on the central portion and the end portion of the photoconductor 12 in the axial direction thereof (longitudinal direction of developer roller), which is the scanning direction of the light beam, respectively, at a predetermined timing, and the detected result of the standard concentration toner image on the end portion detected by the reflection concentration sensor 24 and the detected result of the standard concentration toner image on the central portion detected by the reflection concentration sensor 24 are compared. This is because since the end portion of the developer roller in the longitudinal direction thereof tends to correspond to an area outside of an image or a blank space, the decrease in the development performance by the fixation of toner onto the surface of each developer roller 51, 52 can be detected by comparing the detected value of the standard concentration toner image of the central portion to the detected value of the standard concentration toner image on the end portion. More particularly, the detected value of the standard concentration toner image on the central portion is compared to the detected value of the standard concentration toner image on the end portion, and the bias voltage of the case is controlled by the bias voltage controller 35 of the case according to the results, so that the most suitable bias voltage of the case is always selected, and the excessive fixation of toner onto the developer rollers 51, 52 can be prevented.

Figure 4:
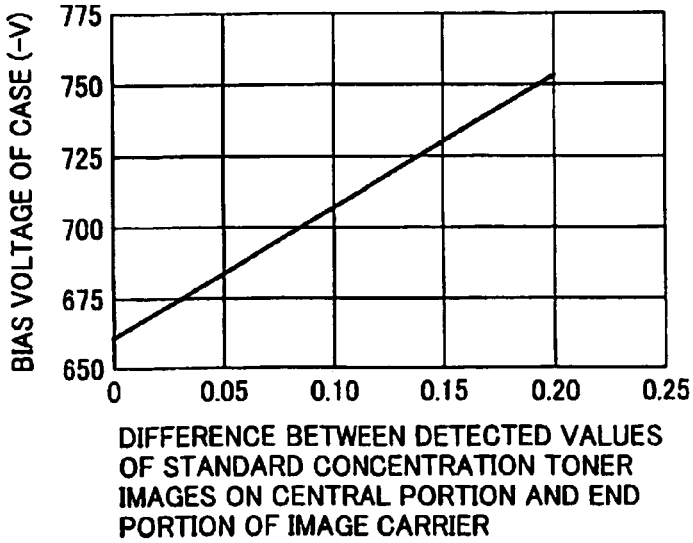
FIG. 4 is a graph illustrating the relationship between the difference of detected values of standard concentration toner images on a central portion and the end portion of the image carrier and the bias voltage of a case in embodiments 2, 6.

The bias voltage of the case is set as illustrated in FIG. 4 according to the difference between the detected value of the standard concentration toner image on the central portion and the detected value of the standard concentration toner image on the end portion ([the detected value of the standard concentration toner image on the central portion]−[the detected value of the standard concentration toner image on the end portion]). If the difference between the detected values of the standard concentration toner images on the central portion and the end portion is increased, the toner image on the end portion shows a standard concentration higher than the standard concentration of the toner image on the central portion, which means the effective development bias voltage on the end portion is increased. For this reason, the adhesion/fixation of toner onto the case is controlled by increasing the bias voltage of the case. The results of the printing experiment of 500000 sheets (corresponding to a maintenance interval) are illustrated in Table. 1. In the bias voltage control of the case according to the present embodiment, the toner did not adhere and was not fixed onto the case after printing 500000 sheets. Accordingly, it is shown that the present embodiment is effective relative to the adhesion/fixation of toner onto the case, compared to the detection of the increase in the effective development bias voltage only on the end portion.

Embodiment 3

The increased amount of the effective development bias voltage by the fixation of toner onto the surface of the developer roller increases with the number of printings up to about 150000 sheets after exchanging developer. However, the increased amount after printing 150000 sheets is relatively small (refer to FIG. 6). Accordingly, in the area where the increased amount of the effective development bias voltage stably fluctuates, the control effect of the adhesion/fixation of toner onto the case can be maintained without changing the bias voltage to the case, and also the consumption of the surplus toner by forming the standard concentration toner image on the end portion can be reduced. In this embodiment, the bias voltage setting value is renewed up to the printing of 200000 sheets, and the finally decided bias voltage of the case is applied after the printing of 200000 sheets, and the standard concentration toner image, which detects the increase in the effective development bias voltage, is not formed.

Figure 5:
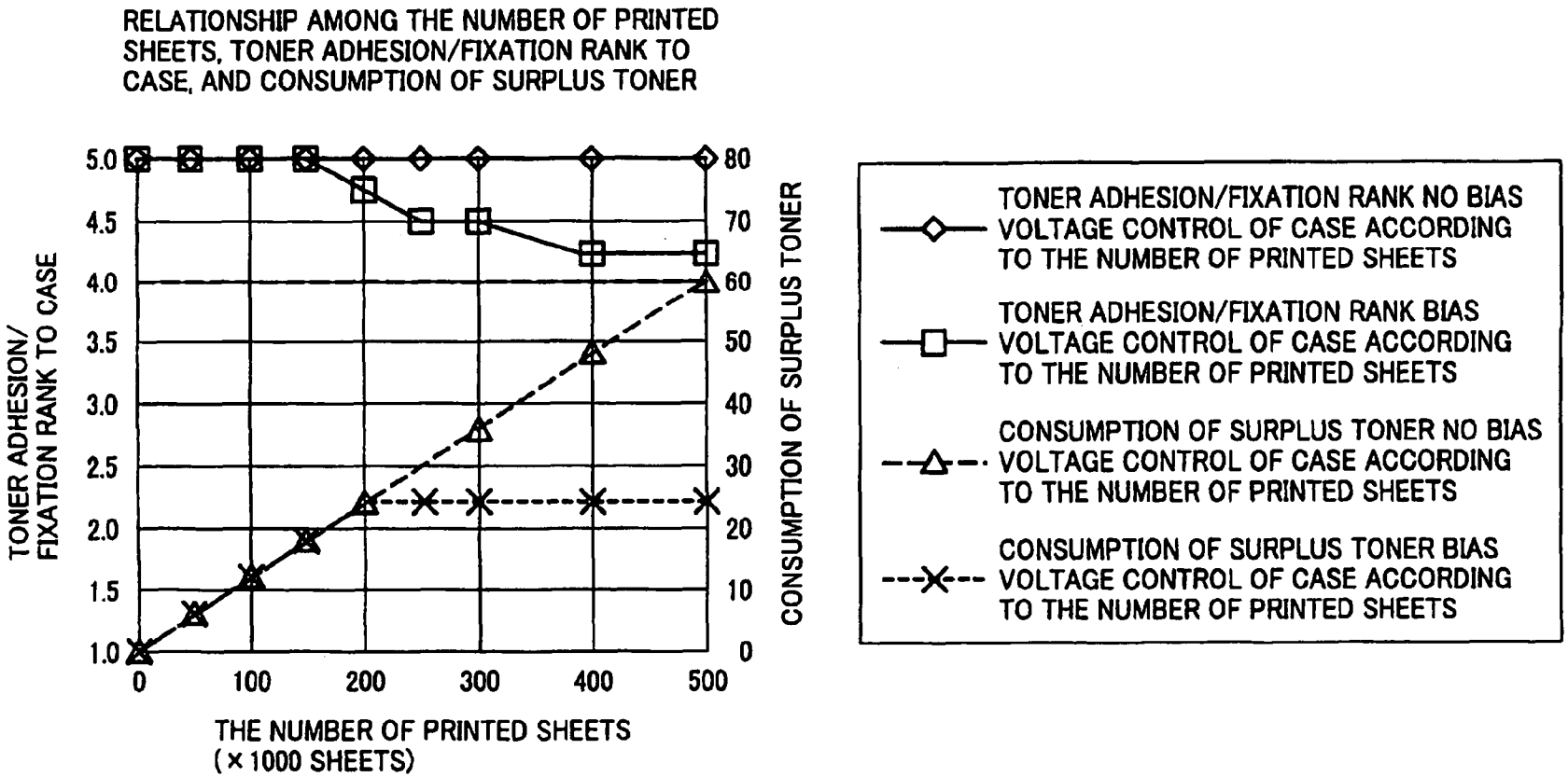
FIG. 5 is a graph illustrating the relationship among the number of printed sheets, the ranks of adhesion/fixation of toner onto the case, and the consumption of surplus toner in embodiment 3.

FIG. 5 illustrates the results of the printing experiment according to the bias voltage control of the case in this embodiment. As to "adhesion/fixation rank of toner onto case" on the vertical axis, the rank 5 means that the adhesion/fixation of toner onto the case is not caused, and the rank 4 or above is an acceptable level. In this case, the acceptable level indicates the adhesion condition of toner in which the toner can be removed by simply shaking the case although the toner adheres to the case. When the bias voltage control of the case is conducted according to the number of printed sheets, the adhesion/fixation of toner onto the case satisfies the acceptable level, and the consumption of the surplus toner for forming the standard concentration toner image, which is required for the detection, is reduced to about ⅓, compared to the case before conducting the bias voltage of the case according to the number of printed sheets. Accordingly, by controlling the bias voltage of the case according to the number of printed sheets, the adhesion/fixation of toner onto the case can be controlled while controlling the consumption of the surplus toner.

Embodiment 4

Figure 6:
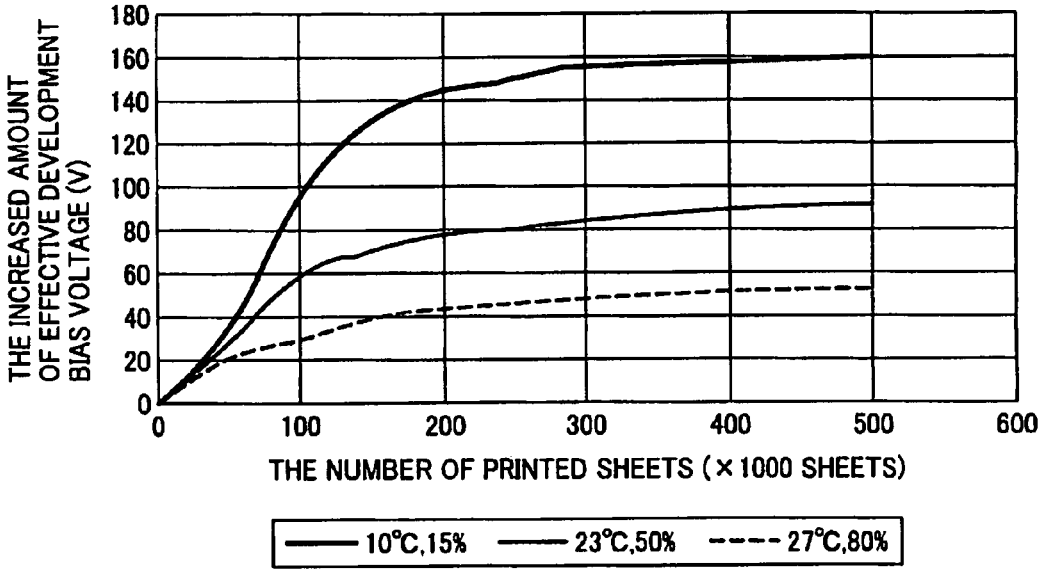
FIG. 6 is a graph illustrating the relationship between the increased amount of effective development bias voltage and the number of printed sheets when humidity is used as a parameter in embodiment 4.
Figure 7:
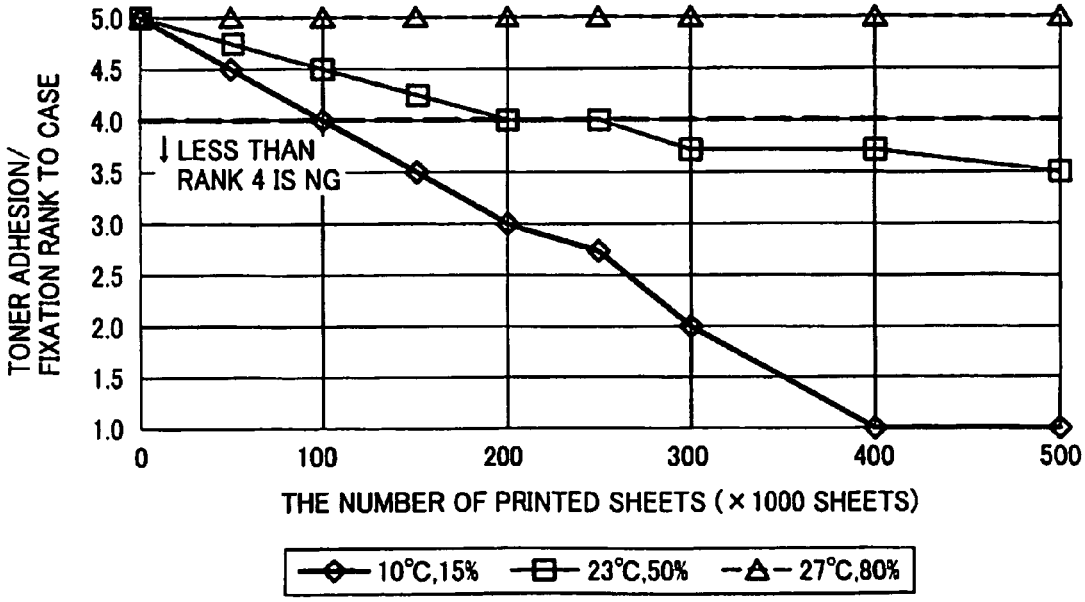
FIG. 7 is a graph illustrating the relationship between the ranks of adhesion/fixation of toner onto the case and the number of printed sheets when humidity is used as a parameter in the embodiment 4 (without controlling the bias voltage of the case).

FIG. 6 illustrates the experimental result of the relationship between the number of printed sheets and the increased amount of effective development bias voltage by the fixation of toner onto the developer roller when changing the environment (temperature and humidity) in which the image forming device is used. FIG. 7 illustrates the experimental result of the relationship between the number of printed sheets and the rank showing the fixation of toner onto the case when changing the environment (temperature and humidity) in which the image forming device is used.

As illustrated in FIGS. 6, 7, the increase in the effective development bias voltage is large in a low-humidity environment (10° C. 15%), so that the adhesion/fixation of toner onto the case is remarkable. This results from the fact that if the amount of charged toner is relatively increased in a low-humidity environment, the development performance of the two-component developer is lowered, so that the toner concentration in the developer is largely controlled for ensuring the development performance.

On the other hand, as the temperature is increased, the increased amount of effective development bias voltage is decreased. In the printing experiment under the environment of 27° C., 80%, the increase in the effective bias voltage is about 50V at the maximum, and the adhesion/fixation of the toner onto the case is minor even if the bias voltage of the case is set to a fixed value. Therefore, the above-described bias voltage control of the case is performed when the humidity is 80% or below, and the bias voltage of the case is set to a fixed value when the humidity is 80% or above, so that the consumption of surplus toner by forming the standard concentration toner image for detecting the increase in the effective development bias voltage and the adhesion/fixation of toner onto the case can be controlled.

Embodiment 5

Figure 8:
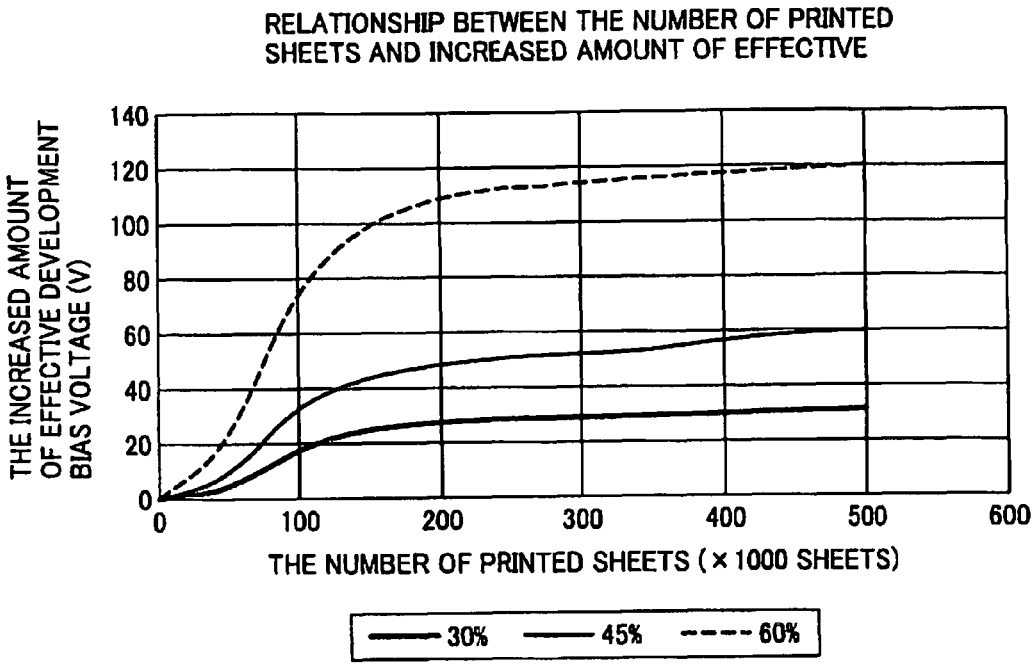
FIG. 8 is a graph illustrating the relationship between the increased effective development bias voltage and the number or printed sheets when the content rate of a toner particle of 4 μm or below in weight average particle diameter is used as a parameter in embodiment 5.
Figure 9:
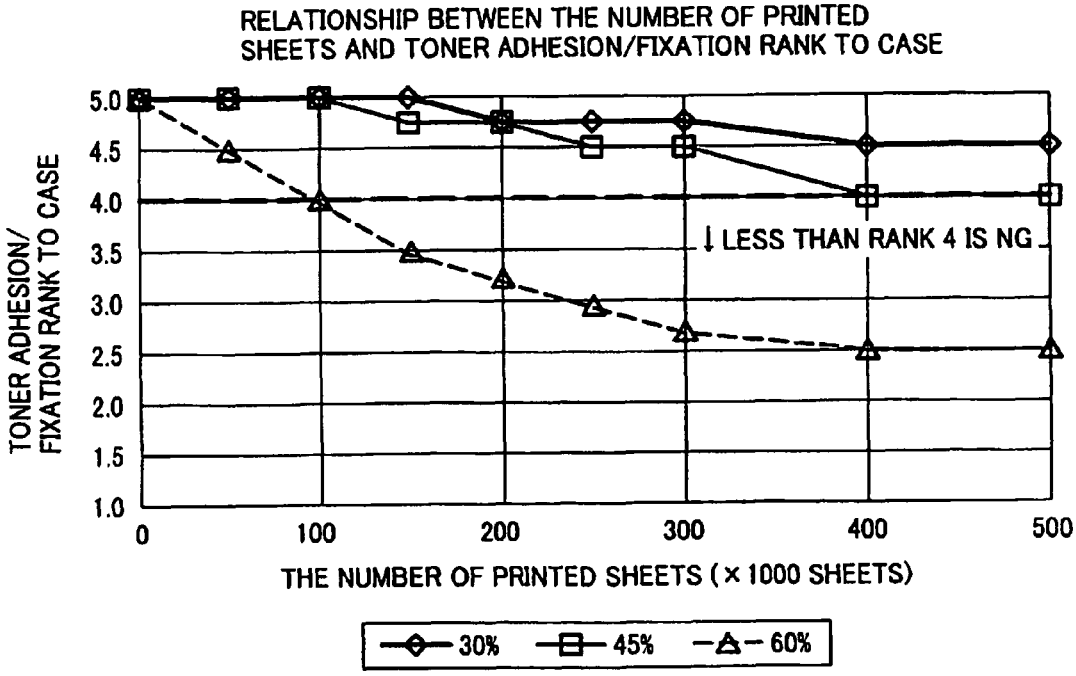
FIG. 9 is a graph illustrating the relationship between the ranks of adhesion/fixation of toner onto the case and the number or printed sheets when the content rate of a toner particle of 4 μm or below in weight average particle diameter is used as a parameter in embodiment 5.

Recently, toner particles each having a small diameter are used for improving the image quality of the image forming device. However, when the toner particles each having a small diameter are used, the proportion of toner particles which can not sufficiently have contact with carriers is increased, so that the fixation of toner is likely to be developed. FIGS. 8, 9 illustrate the experimental results of the relationship between the increased amount of the effective development bias voltage by the fixation of toner onto the developer roller and the number of printed sheets when the content rate of a toner particle of 4 μm or below in weight average particle diameter is used as a parameter (the bias voltage of the case is a fixed value).

According to this result, when the toner including 30%, 45% of toner particles having a weight average particle diameter of 5 μm or below is used, the increased amount of the effective development bias voltage is about 50V, and the adhesion/fixation of toner to the case is minor. When the toner including 60% of such toner particles is used, the increased amount of the effective development bias voltage is over 100V, and the adhesion/fixation of toner to the case is increased. Accordingly, the above-described bias voltage control of the case is especially effective when using the toner including 60% of toner particles having a weight average particle diameter of 5 μm or below.

Embodiment 6

The development station 14 according to this embodiment uses two-component developer containing toner made of toner particles and carries having a weight average particle diameter of 65 μm or below. The toner particles include a range of 4-10 μm of a weight average particle diameter, and 60-80% of the toner particles have a particle diameter of 4 μm or below. The toner may contain a resin component or a coloring agent, and also may contain a wax component or an inorganic particulate. A method of manufacturing the developer is not especially limited. A grinding method or a polymerization method can be used.

The resin component of the toners includes styrene resin (a polymer or a copolymer containing a styrene or a styrene substitution) such as a styrene, a poly-α-stillstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylic acid ester copolymer, a styrene-methacrylic acid ester copolymer, a styrene-α-chloracrylic acid methyl copolymer, or a styrene-acrylonitrile-acrylic acid ester copolymer, a polyester resin, an epoxy resin, a vinyl chloride resin, a rosin modified maleic acid resin, a phenol resin, a polyethylene resin, a polyester resin, a polypropylene resin, a petroleum resin, a polyurethane resin, a ketone resin, an ethylene-ethyl acrylate copolymer, a xylene resin, and a polyvinylbutyrate resin. Each of these resins can be used by itself, but two types of resins can be combined.

The coloring agent is not especially limited. As the coloring agent, a known coloring agent such as a carbon black, a lampblack, an ironblack, an ultramarine blue, a nigrosine dye, an aniline blue, a chalcooil blue, an oil black, or an azo oil black is used. The wax component is also not especially limited. As the wax component, a known wax component such as a carnauba wax, a rice wax, or a synthetic ester wax is used. The inorganic particulate is also not especially limited. As the inorganic particulate, a known inorganic particulate such as a silica or an oxidized titanium fine powder can be used.

As described above, the toner transferred onto the photoconductor 12 is electrostatically transferred onto the transfer member P by the transfer and feeding station 15. However, about 10% of the toner remains on the photoconductor 12 without being transferred onto the transfer member. The toner remaining on the photoconductor 12 (residual toner) is removed from the photoconductor 12 by the cleaning blade 65 or the brush roller 66 provided in the cleaning station 16. The toner removed from the photoconductor 12 by the cleaning station 16 is accumulated in the collection tank 67 in the cleaning station 16. The toner accumulated in the collection tank 67 is fed outside the cleaning station 16 by the collection screw 68, and discharged from a discharging exit (not shown) so as to be guided to a toner recycling station (not shown).

In this embodiment, the standard concentration toner images are formed at a predetermined timing on the central portion and the end portion of the photoconductor 12 in the axial direction thereof, which is the scanning direction of the light beam (the longitudinal direction of the development roller), respectively, by the standard concentration toner image forming unit provided in the copier. These standard concentration toner images are detected by the reflection concentration sensor 24. This is because since the end portion of the developer roller in the longitudinal direction thereof corresponds to an area outside an image or a blank space, the deterioration in the development performance by the fixation of toner onto the surface of each developer roller 51, 52 can be detected by comparing the detected result of the standard concentration toner image on the central portion of the photoconductor 12 to the detected result of the standard concentration toner image on the end portion of the photoconductor 12. More particularly, the detected result of the standard concentration toner image on the central portion of the photoconductor 12 is compared to the detected result of the standard concentration toner image on the end portion of the photoconductor 12, and the bias voltage of the case is controlled by the bias voltage controller 35 of the case according to the detected result. Thereby, the most appropriate bias voltage of the case can be always selected, and the excessive fixation of toner onto the developer rollers 51, 52 can be prevented.

As illustrated in FIG. 4, it is necessary to increase the bias voltage of the case as the difference of the detected values of the standard concentration toner images on the central portion and the end portion of the developer roller in the longitudinal direction thereof is increased (as the detected value of the standard concentration toner image on the end portion of each developer roller 51, 52 in the axial direction thereof becomes smaller than the detected value of the standard concentration toner image on the central portion). As described above, the generation of a defective image associated with the fixation of toner onto the case such as the stained surface can be controlled by controlling the bias voltage of the case by means of the bias voltage controller 35 of the case according to the detected value of the standard concentration toner image by the reflection concentration sensor 24.

In order to check the control operation by the bias voltage controller 35 of the case, the printing experiment onto 300000 sheets (corresponding to a maintenance interval) was conducted by using the image forming device in this embodiment, and the fixation of toner onto the case 59 was checked. As a result, when the bias voltage of the case was controlled, the toner was not fixed to the case 59 at the printing of 300000 sheets, and the development station 14 could be reused after the maintenance. However, when the bias voltage of the case was fixed at a constant voltage without conducting the control of the bias voltage of the case, the toner was fixed onto the case 59 at the printing of 200000 sheets.

As described above, the bias voltage of the case can be more accurately, easily and precisely controlled by the bias voltage controller 35 of the case by detecting the increase in the effective development bias voltage caused by the fixation of toner. In the embodiment of the present invention, a different surface potential is used on the central portion and the end portion of the image carrier such that the difference between the detected values of the standard concentration toner images of the central portion and the end portion becomes clear. Thereby, the increase in the effective development bias voltage caused by the fixation of toner becomes remarkable. More particularly, the surface potential on the central portion is set to −300V and the surface potential of the end portion is set to −200V. Therefore, the development performance of the standard concentration toner image on the end portion is increased, and the increase in the effective development bias voltage by the fixation of toner can be easily detected. In addition, [the latent image potential of the standard concentration toner image on the central portion−the bias voltage of the development roller] can be set to −300V and [the latent image potential of the standard concentration toner image on the end portion−the bias voltage of the developer roller] is set to −200V. In this case, when the fixation amount of toner onto the developer roller is low, the toner is not developed to the standard concentration toner image, and the toner is developed when the effective development bias voltage is increased. Accordingly, the sensitivity for detecting the increase in the effective development bias voltage by the fixation of toner is improved, and the consumption of toner can be controlled. The surface potential can be set by adjusting the writing light volume in each case. By controlling the bias voltage of the case according to the increased value of the effective development bias voltage, the adhesion/fixation of toner onto the case 59 can be controlled, so that the defects associated with the adhesion/fixation can be controlled. Moreover, a replacement cycle for the development station can be extended. In addition, in FIG. 2, the surface potential of the image carrier (photoconductor 12) is detected by a surface potentiometer 36.

Embodiment 7

As another embodiment, a distance of the space (developer amount control space) which is formed between the developer roller 1 and the doctor blade 57 and controls the toner amount (developer amount) to be supplied to the photoconductor is different between the central portion and the end portion of the developer roller in the axial direction thereof, such that the distance of the space at the end portion is set longer than that at the central portion. More particularly, the developer amount control space is set to 0.6 mm on the central portion and is set to 0.7 mm on the end portion of the surface of the developer roller, so that the development performance of the standard concentration toner image on the end portion is improved, and the increase in the effective development bias voltage by the fixation of toner can be easily detected. As described above, the distance of the developer amount control space is set to be different on the central portion and the end portion of the surface of the developer roller, so that the fixation of toner onto the developer roller 51 can be effectively detected, and the replacement cycle of the development station 14 can be extended by controlling the adhesion/fixation of toner onto the case 59.

Embodiment 8

As another embodiment, a different roughness is applied on the central portion and the end portion of the developer roller 51 made of aluminum in the axial direction of the roller, and the surface roughness on the end portion is set larger than that on the central portion, so that the fixation of the toner onto the development roller 51 is accelerated, and the difference of the detected values of the standard concentration toner images on the central portion and the end portion can be increased. More particularly, a sandblast process is performed on the central portion and the end portion of the circumference face of the developer roller in the axial direction thereof, so that the surface roughness on the central portion and the surface roughness on the end portion are different to each other. The surface roughness on the central portion is set to Ra=0.4 μm, Ry=3 μm, and Rz=2 μm, and the surface roughness on the end portion is set to Ra=5 μm, Ry=30 μm, and Rz=20 μm. If the surface roughness is large, the toner is easily adhered onto the asperity of the surface of the developer roller 51, so that the fixation of toner onto the developer roller 51 is accelerated, and the difference between the detected values of the standard concentration toner images on the central portion and the end portion of the image carrier is increased.

Figure 10:
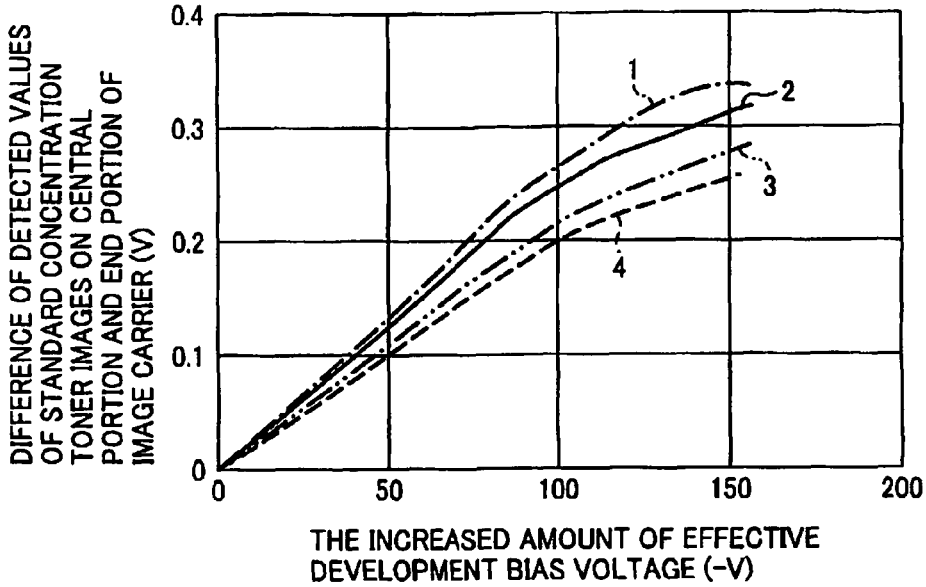
FIG. 10 is a graph illustrating the relationship between the increased amount of an effective development bias voltage and the difference of the detected values of the standard concentration toner images on the central portion and the end portion of the image carrier when a method for clarifying the difference of the detected values of the standard concentration toner images on the central portion and the end portion of the image carrier is used as a parameter.

FIG. 10 is a graph illustrating the relationship between the difference of the detected values of the standard concentration toner images on the central portion and the end portion of the image carrier and the increased amount of effective development bias voltage by the fixation of toner when a measure for clarifying the difference of the detected values of the standard concentration of the toner images on the central portion and the end portion of the image carrier is taken and when such a measure is not taken. In FIG. 10, the curved line 1 illustrates the result when the surface roughness of the central portion and the surface roughness of the end portion of the developer roller are different to each other, the curved line 2 illustrates the result when the surface potential of the central portion and the surface potential of the end portion of the image carrier are different to each other, the curved line 3 illustrates when the distance of the developer amount control gap on the central portion and the distance of the developer amount control gap on the end portion of the image carrier are different to each other, and the curved line 4 illustrates when the measure for clarifying the difference of the detected values of the standard concentration toner images on the central portion and the end portion of the image carrier is not taken. According to the results, compared to the case when the measure for clarifying the difference of the detected values of the standard concentration toner images on the central portion and the end portion of the image carrier is not taken (curved line 4), when such a measure is taken (curved lines 1-3), the sensitivity of the difference of the detected values of the standard concentration toner images on the central portion and the end portion of the image carrier can be improved, relative to the increased amount of the effective development bias voltage by the fixation of toners.

The generation of the toner fixation onto the surface of the developer roller is different according to the environment in which the image forming device is used, especially, the change in the temperature. According to the embodiment of the present invention, the temperature of the circumference of the image carrier in the image forming device is detected by a temperature sensor 37 (refer to FIG. 2), and the bias voltage of the case is conducted by the bias voltage controller 35 of the case according to the humidity of the circumference of the image carrier (photoconductor 12).

Figure 11:
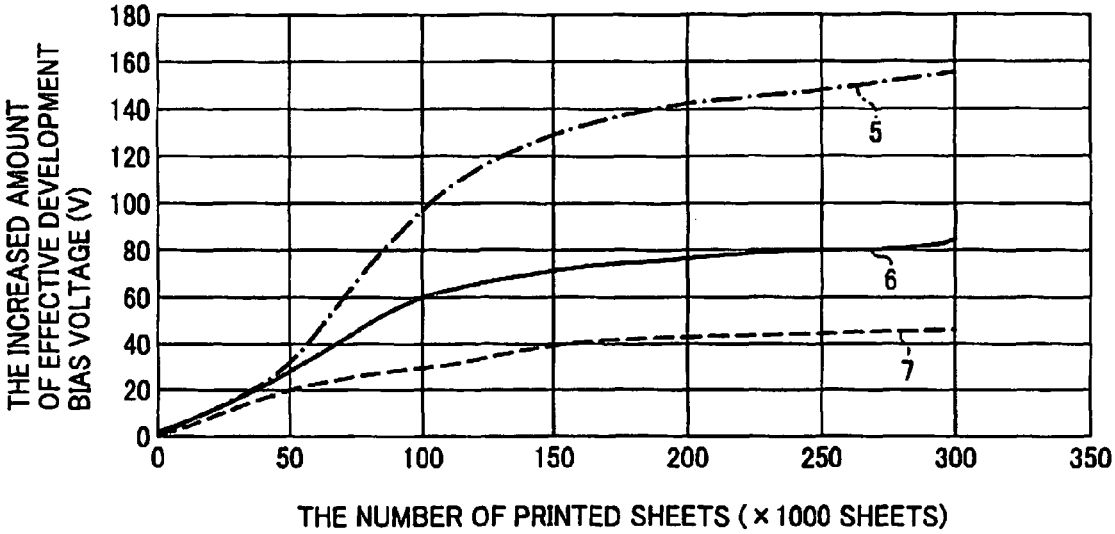
FIG. 11 is a graph illustrating the relationship between the increased amount of an effective development bias voltage and the number of printed sheets when humidity is used as a parameter.

FIG. 11 is a graph illustrating the relationship between the number of printed sheets and the increased amount of the effective development bias voltage when the temperature and the humidity are changed. In FIG. 11, the curved line 5 illustrates the result when the temperature is 10° C. and the humidity is 15% RH, the curved line 6 illustrates the result when the temperature is 23° C. and the humidity is 50% RH, and the curved line 7 illustrates the result when the temperature is 27° C. and the humidity is 80% RH. According to the results, in the low temperature and low humidity environment, as the number of printed sheets is increased, the increased amount of the effective development bias voltage caused by the fixation of toner is increased. On the other hand, in the high humidity environment, the increased amount of the effective development bias voltage is remarkable even if the number of printed sheets is increased. Accordingly, by controlling the bias voltage of the case when the humidity is less than 50% RH and setting the bias voltage of the case to a fixed value without controlling the bias voltage of the case when the humidity is 50% RH or more, the adhesion/fixation of toner to the case 59 can be controlled without excessively transferring the toner to the developer roller 51.

Recently, toner particles each having a reduced diameter are used for improving the image quality of the image forming device. The generation status of the fixation of toner onto the developer roller when the diameter of the toner particle is changed was examined.

Figure 12:
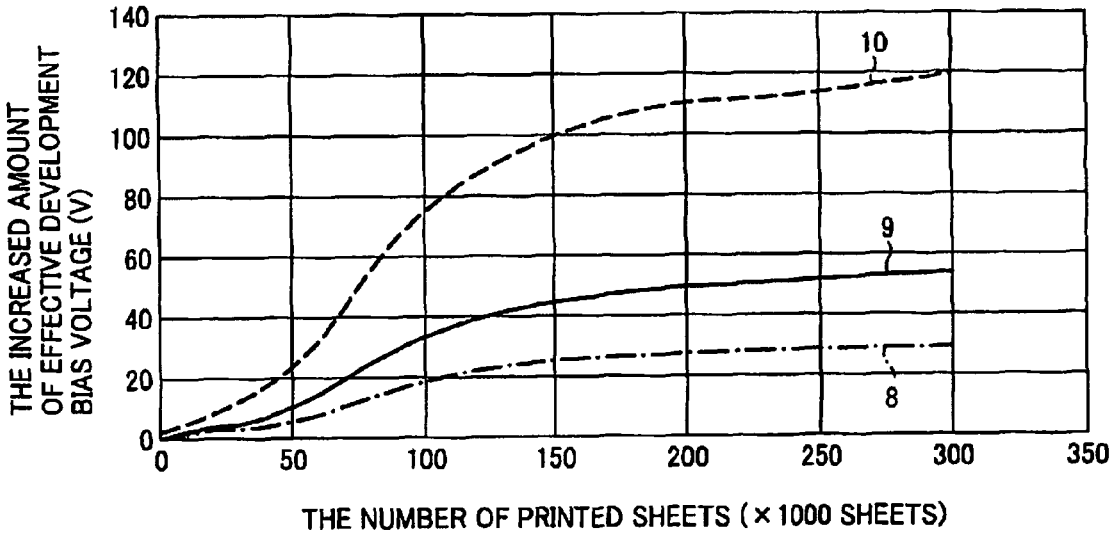
FIG. 12 is a graph illustrating the relationship between the increased amount of an effective development bias voltage and the number of printed sheets when the content ratio of a toner particle of 4 μm or below in weight average particle diameter is used as a parameter.

FIG. 12 is a graph illustrating the relationship between the number of printed sheets and the increased amount of the effective development bias voltage when the diameter of the toner particle is changed. In FIG. 12, the curved line 8 illustrates the result when the toner content of the weight average particle diameter of 4 μm or below is 30%, the curved line 9 illustrates the result when the toner content the weight average particle diameter of 4 μm or below is 45%, and the curved line 10 illustrates when the toner content of the weight average particle diameter of 4 μm or below is 60%. According to the results, as the toner content of the weight average particle diameter of 4 μm or below is increased, the increased amount of the effective development bias voltage by the fixation of toner to the developer roller is increased. Especially, when toner having 60% of the toner content is used, the increased amount of the effective development bias voltage is increased, compared to the case when the toner having 30% of the toner content and the toner having 45% of the toner content are used. Therefore, in the embodiment of the present invention, it is especially effective when the toner having 60% or more of the toner content having the weight average particle diameter of 4 μm or below is used.

In the above embodiments, the drum-shaped photoconductor 12 is used as the image carrier, but an endless belt-shaped photoconductor can be used.

Next, the effects of the image forming device according to the embodiments of the present invention will be described.

The image forming device according to the embodiment of the present invention includes the image carrier including the surface onto which the electrostatic latent image is formed, the development station including the case made of the conductive body and one or more developer rollers, which supply the toner housed in the case to the surface of the image carrier, and develop the electrostatic latent image formed on the surface of the image carrier as the toner image, the unit, which forms the standard concentration toner image of on the surface of the image carrier, the detector, which detects the toner adhesion amount of the standard concentration toner image formed on the surface of the image carrier by the standard concentration toner image-forming unit, and the voltage controller, which controls the bias voltage to be applied to the case according to the detected result of the toner adhesion amount of the standard concentration toner image by the detector.

According to the above-described structure, the bias voltage to be applied to the case is more precisely, easily and effectively controlled. Therefore, the adhesion/fixation of toner to the case can be effectively controlled, and the replacement cycle of the development station can be extended.

Preferably, the standard concentration toner image-forming unit forms the standard concentration toner image on the surface of the central portion and the surface of the end portion of the image carrier in the longitudinal direction thereof, the detector detects the toner adhesion amount of the standard concentration toner image formed on the surface of the central portion and the surface of the end portion of the image carrier in the longitudinal direction thereof, and the voltage controller controls the bias voltage to be applied to the case according to the difference between the toner adhesion amount of the standard concentration toner image formed on the surface of the central portion of the image carrier in the longitudinal direction thereof detected by the detector and the toner adhesion amount of the standard concentration toner image formed on the surface of the end portion of the image carrier in the longitudinal direction thereof detected by the detector.

According to the above-described structure, the bias voltage to be applied to the case is more precisely, easily and effectively controlled. Therefore, the adhesion/fixation of toner to the case can be effectively controlled, and the replacement cycle of the development station can be extended.

Preferably, the standard concentration toner image-forming unit forms the standard concentration toner image on the surface of the central portion and the surface of the end portion of the image carrier in the longitudinal direction thereof at a different latent image electric potential to each other.

According to the above-described structure, the difference between the detected values of the reference concentration toner images on the central portion and the end portion of the image carrier is increased, so that the increase in the effective development bias voltage by the toner adhesion to the image carrier can be easily and effectively controlled.

Preferably, the image forming device further includes the doctor blade, which is disposed to face the developer roller, and controls the amount of toner to be supplied to the surface of the image carrier by the developer roller, and the distance of the space formed between the developer roller and the doctor blade is different at the central portion and the end portion of the developer roller in the longitudinal direction thereof.

According to the above-described structure, the difference between the detected values of the reference concentration toner images on the central portion and the end portion of the image carrier is increased, so that the increase in the effective development bias voltage by the toner adhesion to the image carrier can be easily and effectively controlled.

Preferably, the surface roughness of the developer roller is different on the central portion and the end portion of the developer roller in the longitudinal direction thereof.

According to the above-described structure, the difference between the detected values of the reference concentration toner images on the central portion and the end portion of the image carrier is increased, so that the increase in the effective development bias voltage by the toner adhesion to the image carrier can be easily and effectively controlled.

Preferably, the image forming device further includes the humidity detector, which detects the humidity of the circumference of the image forming device, and the voltage controller controls the bias voltage to be applied to the case according to the humidity detected by the humidity detector.

According to the above-described structure, the adhesion/fixation of toner to the case can be effectively controlled while controlling the surplus toner consumption, and a defect associated with the adhesion/fixation can be controlled. In addition, the replacement cycle of the development station can be extended.

Preferably, the toner includes toner particles having a range of 4-10 μm of a weight average particle diameter and 60-80% of the toner particles have a weight average particle diameter of 4 μm or below.

According to the above-described structure, the adhesion/fixation of toner to the case can be effectively controlled while achieving a high quality image by toner, and a defect associated with the adhesion/fixation can be controlled. In addition, the replacement cycle of the development station can be extended.

Preferably, the image forming device further includes the voltage application unit, which applies the bias voltage to the development rollers, and the bias voltage to be applied by the voltage application unit to the developer roller disposed most downstream of the rotation direction of the image carrier is different from the bias voltage to be applied by the voltage application unit to the other developer roller.

According to the above-described structure, the adhesion/fixation of toner to the case can be effective controlled, and a defect associated with the adhesion/fixation can be controlled. In addition, the replacement cycle of the development station can be extended.

Preferably, the standard concentration toner image-forming unit forms the standard concentration toner image on the central portion and the end portion of the image carrier in the longitudinal direction thereof, the detector detects the toner adhesion amount of the standard concentration toner image formed on the central portion and the end portion of the image carrier in the longitudinal direction thereof, the voltage controller controls the bias voltage to be applied to the case according to the difference between the toner adhesion amount of the standard concentration toner image formed on the central portion of the image carrier in the longitudinal direction thereof detected by the detector and the toner adhesion amount of the standard concentration toner image formed on the end portion of the image carrier in the longitudinal direction thereof detected by the detector.

According to the above-described structure, the bias voltage to be applied to the case can be more precisely, easily and effective controlled. Therefore, the adhesion/fixation of toner to the case is effectively controlled, and a defect associated with the adhesion/fixation of toner can be controlled. In addition, the replacement cycle of the development station can be extended.

Preferably, the image forming device further includes a counter which counts the number of printed sheets of the toner image formed on the image carrier, and the voltage controller controls the bias voltage to be applied to the case according to a result of the counter.

According to the above-described structure, the adhesion/fixation of toner to the case can be effective controlled while controlling the surplus toner consumption, and a defect associated with the adhesion/fixation can be controlled. In addition, the replacement cycle of the development station can be extended.

Preferably, the image forming device further includes the humidity detector, which detects the humidity of the circumference of the image forming device, and the voltage controller controls the bias voltage to be applied to the case according to the humidity detected by the humidity detector.

According to the above-described structure, the adhesion/fixation of toner to the case can be effectively controlled while controlling the surplus toner consumption, and a defect associated with the adhesion/fixation can be controlled. In addition, the replacement cycle of the development station can be extended.

Preferably, the toner includes toner particles having a range of 5-10 μm of a weight average particle diameter and 60-80% of the toner particles have a weight average particle diameter of 5 μm or below.

According to the above-described structure, the adhesion/fixation of toner to the case can be effectively controlled while achieving a high quality image by the toner, and a defect associated with the adhesion/fixation can be controlled. In addition, the replacement cycle of the development station can be extended.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. An image forming device, comprising:

an image carrier including a surface onto which an electrostatic latent image is formed;

a development station including a case made of a conductive body and one or more developer rollers, which supply toner housed in the case to the surface of the image carrier, and develop the electrostatic latent image formed on the surface of the image carrier as a toner image;

a unit, which forms a standard concentration toner image of on the surface of the image carrier;

a detector, which detects a toner adhesion amount of the standard concentration toner image formed on the surface of the image carrier by the standard concentration toner image-forming unit; and a voltage controller, which controls a bias voltage to be applied to the case according to a detected result of the toner adhesion amount of the standard concentration toner image by the detector.

2. The image forming device according to claim 1, wherein the standard concentration toner image-forming unit forms the standard concentration toner image on a surface of a central portion and a surface of an end portion of the image carrier in a longitudinal direction thereof, the detector detects the toner adhesion amount of the standard concentration toner image formed on the surface of the central portion and the surface of the end portion of the image carrier in the longitudinal direction thereof, and the voltage controller controls the bias voltage to be applied to the case according to a difference between the toner adhesion amount of the standard concentration toner image formed on the surface of the central portion of the image carrier in the longitudinal direction thereof detected by the detector and the toner adhesion amount of the standard concentration toner image formed on the surface of the end portion of the image carrier in the longitudinal direction thereof detected by the detector.

3. The image forming device according to claim 2, wherein the standard concentration toner image-forming unit forms the standard concentration toner image on the surface of the central portion and the surface of the end portion of the image carrier in the longitudinal direction thereof at a different latent image electric potential to each other.

4. The image forming device according to claim 2, further comprising a doctor blade, which is disposed to face the developer roller, and controls the amount of toner to be supplied to the surface of the image carrier by the developer roller, wherein a distance of a space formed between the developer roller and the doctor blade is different at the central portion and the end portion of the developer roller in the longitudinal direction thereof.

5. The image forming device according to claim 2, wherein a surface roughness of the developer roller is different on the central portion and the end portion of the developer roller in the longitudinal direction thereof.

6. The image forming device according to claim 2, further comprising a humidity detector, which detects humidity of a circumference of the image forming device, wherein the voltage controller controls the bias voltage to be applied to the case according to the humidity detected by the humidity detector.

7. The image forming device according to claim 2, wherein the toner includes toner particles having a range of 4-10 μm in terms of a weight average particle diameter and 60-80% of the toner particles have a weight average particle diameter of 4 μm or below.

8. The image forming device according to claim 2, further comprising a voltage application unit, which applies a bias voltage to the development rollers, wherein the bias voltage to be applied by the voltage application unit to the developer roller disposed in a most downstream rotation direction of the image carrier is different from the bias voltage to be applied by the voltage application unit to another developer roller.

9. The image forming device according to claim 8, wherein the standard concentration toner image-forming unit forms the standard concentration toner image on a central portion and an end portion of the image carrier in the longitudinal direction thereof, the detector detects the toner adhesion amount of the standard concentration toner image formed on the central portion and the end portion of the image carrier in the longitudinal direction thereof, and the voltage controller controls the bias voltage to be applied to the case according to a difference between the toner adhesion amount of the standard concentration toner image formed on the central portion of the image carrier in the longitudinal direction thereof detected by the detector and the toner adhesion amount of the standard concentration toner image formed on the end portion of the image carrier in the longitudinal direction thereof detected by the detector.

10. The image forming device according to claim 8, further comprising a counter, which counts the number of printed sheets of the toner image formed on the image carrier, wherein the voltage controller controls the bias voltage to be applied to the case according to a result of the counter.

11. The image forming device according to claim 8, further comprising a humidity detector, which detects humidity of a circumference of the image forming device, wherein the voltage controller controls the bias voltage to be applied to the case according to the humidity detected by the humidity detector.

12. The image forming device according to claim 8, wherein the toner includes toner particles having a range of 5-10 μm in terms of a weight average particle diameter and 60-80% of the toner particles have a weight average particle diameter of 5 μm or below.

* * * * *